US007347432B2

(12) United States Patent
Myers et al.

(10) Patent No.: US 7,347,432 B2
(45) Date of Patent: Mar. 25, 2008

(54) CHILD WALKER

(75) Inventors: Peter Jonathan Myers, Wheaton, IL (US); Thomas N. Koltun, Chicago, IL (US); Abdelkrim Bedja, Chicago, IL (US)

(73) Assignee: Kolcraft Enterprises, Inc., Chicago, IL (US)

( * ) Notice: Subject to any disclaimer, the term of this patent is extended or adjusted under 35 U.S.C. 154(b) by 0 days.

(21) Appl. No.: 11/032,841

(22) Filed: Jan. 11, 2005

(65) Prior Publication Data

US 2005/0179223 A1 Aug. 18, 2005

Related U.S. Application Data

(62) Division of application No. 10/159,491, filed on May 31, 2002, now Pat. No. 6,863,287.

(51) Int. Cl.
*B62B 7/12* (2006.01)

(52) U.S. Cl. ..... 280/87.051; 280/648; 280/47.371; 135/67; 446/471; 297/118

(58) Field of Classification Search ..... 280/87.051, 280/648, 650, 658, 47.36, 47.371, 47.38; 135/66, 67, 74; 297/6, 118, 183.3; 446/451, 446/470, 471; 482/67–69
See application file for complete search history.

(56) References Cited

U.S. PATENT DOCUMENTS

| | | | | |
|---|---|---|---|---|
| 8,478 A | | 10/1851 | Rice | |
| 11,140 A | | 6/1854 | Robinson | |
| 149,178 A | | 3/1874 | Wright | |
| 432,378 A | | 7/1890 | Davidson et al. | |
| 517,403 A | | 3/1894 | Bradish et al. | |
| 671,058 A | | 4/1901 | Resetar | |
| 1,141,123 A | | 6/1915 | Knight | |
| 1,428,039 A | | 9/1922 | Kratz | |
| 1,448,783 A | * | 3/1923 | Blewitt et al. | 297/6 |
| 1,656,637 A | | 1/1928 | Hudson | |
| 2,198,813 A | | 4/1940 | Hall | |
| 2,282,086 A | | 5/1942 | Peltier | |
| 2,312,602 A | | 3/1943 | Taylor | |
| 2,609,030 A | * | 9/1952 | Stack | 297/6 |
| 2,697,478 A | | 12/1954 | McKinney | |
| 2,709,079 A | | 5/1955 | Bubb et al. | |

(Continued)

FOREIGN PATENT DOCUMENTS

EP 0 275 497 A1 7/1988

OTHER PUBLICATIONS

*Entertainer Activity Center®*, Graco Owner's Manual, pp. 1-11 (2001).

(Continued)

*Primary Examiner*—J. A Shriver
(74) *Attorney, Agent, or Firm*—Hanley, Flight & Zimmerman, LLC

(57) ABSTRACT

A child walker is provided that includes a frame having a plurality of wheels. The walker includes a handle that is positionable in a first position and a second position. A seat is attached to the frame when the handle is in the first position. When the handle is in the second position, it is positioned to be gripped by a standing child.

3 Claims, 11 Drawing Sheets

U.S. PATENT DOCUMENTS 2,765,839 A 10/1956 Arpin
2,812,012 A 11/1957 Hansburg
2,907,372 A * 10/1959 Leger ..... 280/7.1
2,910,111 A 10/1959 Hansburg
2,978,245 A 4/1961 Rempel
2,988,358 A 6/1961 Mills
3,009,733 A 11/1961 Gelman
3,145,048 A 8/1964 Etal
3,235,254 A 2/1966 Robson
3,337,230 A 8/1967 Golding
3,494,613 A 2/1970 Hatfield
3,692,359 A 9/1972 Boucher
4,025,107 A 5/1977 Chippa
4,045,045 A 8/1977 Boucher et al.
4,084,273 A 4/1978 Haynes
4,141,588 A 2/1979 Anderson
4,160,553 A 7/1979 Fleischer
4,165,127 A 8/1979 Vago
4,171,847 A 10/1979 Tukui
4,231,582 A 11/1980 Moss
4,261,588 A 4/1981 Kassai
4,359,242 A 11/1982 Gerken et al.
D295,397 S 4/1988 Brownlie et al.
4,743,008 A 5/1988 Fermaglich et al.
4,773,639 A 9/1988 Graves
4,799,700 A 1/1989 Knoedler et al.
4,830,345 A 5/1989 Mar
4,844,209 A 7/1989 Sedlack
D315,644 S 3/1991 White
5,013,032 A 5/1991 Baum et al.
5,050,862 A 9/1991 Saghafi
5,054,851 A 10/1991 Chiu
5,083,806 A 1/1992 Brown
5,085,428 A 2/1992 Fermaglich et al.
D327,777 S 7/1992 Tepper
D332,529 S 1/1993 Shuler
5,178,438 A 1/1993 Beger
5,211,607 A 5/1993 Fermaglish et al.
5,302,163 A 4/1994 Fermaglich et al.
5,320,122 A 6/1994 Jacobson et al.
5,366,231 A 11/1994 Hung
5,407,246 A 4/1995 Meeker et al.
5,415,590 A 5/1995 Steingraber et al.
5,433,682 A 7/1995 Fermaglich et al.
5,441,289 A 8/1995 Spielberger
5,474,483 A 12/1995 Sun
5,662,344 A 9/1997 Lu
5,688,211 A 11/1997 Myers
5,700,201 A 12/1997 Bellows et al.
5,704,576 A 1/1998 Meeker et al.
5,722,503 A 3/1998 Haller
5,788,253 A 8/1998 Thomson et al.
5,813,681 A 9/1998 Saint et al.
5,813,720 A 9/1998 Huang
5,888,178 A 3/1999 Welsh, Jr.
5,934,747 A 8/1999 Garland
6,048,290 A * 4/2000 Chen et al. ..... 482/68
6,155,902 A 12/2000 Kole, Jr. et al.
6,179,376 B1 1/2001 Meeker et al.
6,206,384 B1 3/2001 Chi et al.
6,231,056 B1 5/2001 Wu
D443,233 S 6/2001 Gaudet et al.
D445,143 S 7/2001 Bellows
6,296,268 B1 10/2001 Ford et al.
6,299,247 B1 10/2001 Meeker et al.
D465,440 S 11/2002 Ventrola et al.
6,863,287 B2 * 3/2005 Myers et al. ..... 280/87.051

OTHER PUBLICATIONS

Model No. 4654, Graco Owner's Manual, pp. 1-32 (2002).

* cited by examiner

CHILD WALKER

This is a Divisional of U.S. application Ser. No. 10/159,491 filed May 31, 2002 now U.S. Pat. No. 6,863,287.

FIELD OF DISCLOSURE

This specification relates generally to child walkers and, more particularly, to a convertible child walker for use by a child transitioning toward standing and walking.

BACKGROUND

Child walkers are generally suitable for children who have not yet developed the ability to walk. Typically, a walker has a sling-type seat for supporting a child in an upright position such that the child's feet touch the ground. Wheels supporting the walker allow easy movement of the walker on the ground. When seated in the walker, a child pushes off the ground in an effort to simulate walking, thereby moving the walker.

When a child develops the ability to walk, a traditional baby walker becomes obsolete because its support function is no longer needed by the child.

DESCRIPTION OF THE PREFERRED EXAMPLES

Figure 1:
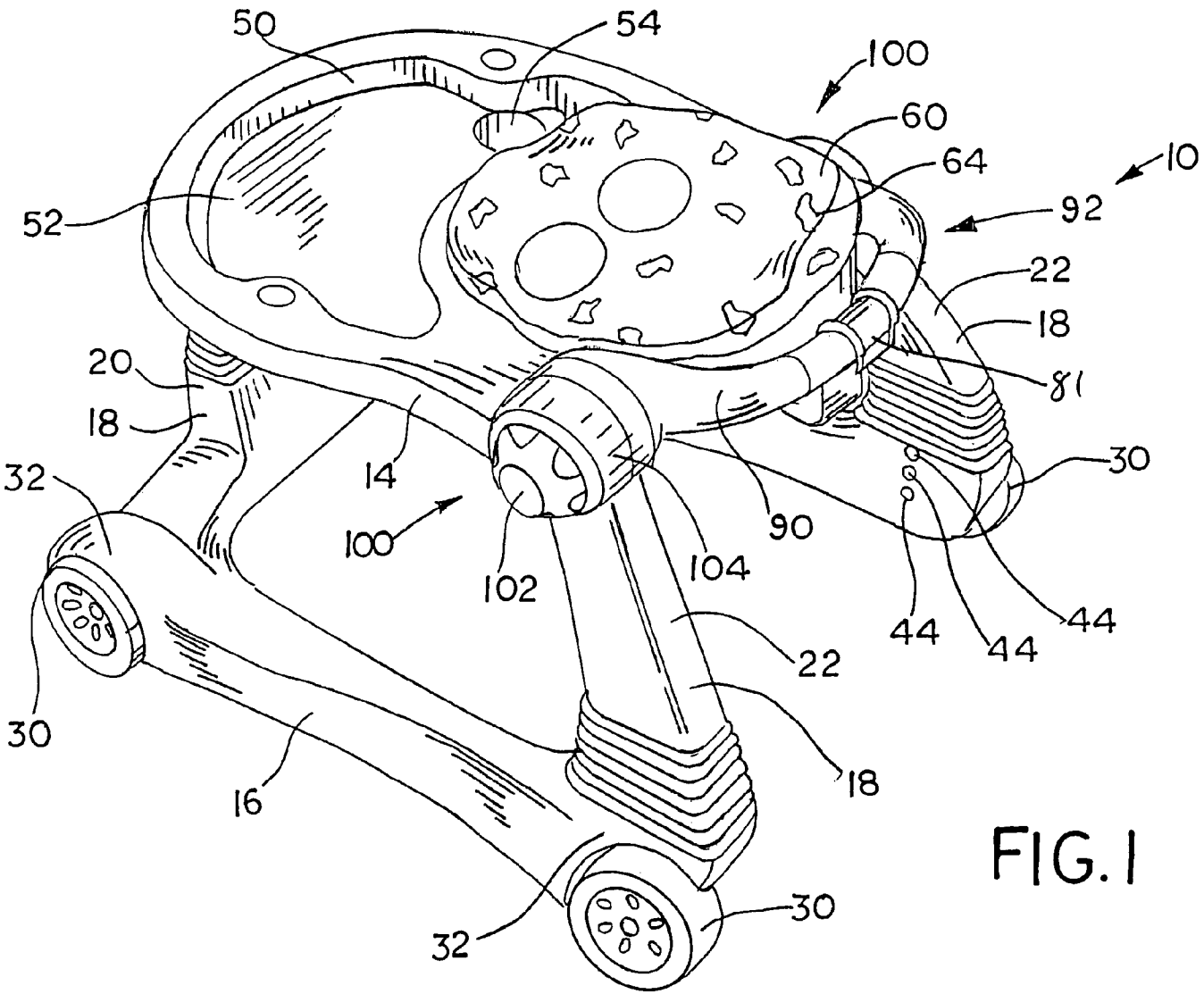
FIG. 1 is a perspective view of an exemplary walker constructed in accordance with the teachings of the instant invention.

An exemplary convertible walker 10 constructed in accordance with the teachings of the invention is shown generally in FIGS. 1-6. For supporting the weight of a child, the convertible walker 10 is provided with a frame 12, which includes an upper section 14, a lower section 16, and a number of support members 18 joining the upper and lower sections 14, 16. As will be apparent to those of ordinary skill in the art, the frame 12 may be constructed in any shape and include any number of support members so as to provide stability and support for the convertible walker 10 when being used by a child. However, in the preferred example, the frame 10 is open ended and includes a front support member 20 and two rear support members 22. In the specific example shown, the upper section 14 and the lower section 16 of the frame 12 are generally U-shaped. A child using the convertible walker 10, whether sitting, standing or walking, may be positioned inside the U-shaped portion of the frame 12. Positioning of the child within the U-shaped frame provides enhanced stability and control for the child.

To provide travel of the convertible walker 10 on a surface, the lower section 16 is supported by a number of wheels 30. It will be apparent to those of ordinary skill in the art that at least three wheels are required to provide balanced movement of the convertible walker 10 on a surface. However, in the preferred example, the lower section 16 is supported on four wheels 30, with each wheel 16 positioned as far as possible from an adjacent wheel 30 so as to provide a highly stable platform for the convertible walker 10. The wheels 30 are preferably sized to provide smooth rolling thereof on any type of surface. The wheels 30 are preferably covered by portions of the lower section 16 that are correspondingly contoured to form wheel covers 32. Preferably, at least the rear wheels are covered in a thin TPR strip to make the walker less susceptible to slipping when exposed to lateral forces.

To provide height adjustability of the upper section 14 relative to the lower section 16, the support members 18 are adjustably connected to the lower section 16. A lower portion of each support member 18 includes a button 40 disposed on a tab 42 (shown in FIG. 6). One end of each tab 42 is attached to a corresponding support member 18. Also, each tab 42 is biased away from the corresponding support member 18. In other words, the tab 42 resists in a spring-like manner from being pressed toward the corresponding support member 18. As will be apparent to those of ordinary skill in the art, the bias in the tab 42 may be produced in many well known ways. For example, one end of the tab 42 may be attached to a corresponding support member 18 with a hinge having an internal coil spring. The tab 42 may also be attached to a corresponding support member 18 at one end with a hinge and include one or more springs disposed between the tab 42 and the support member 18. However, in the preferred example, the tab 42 is constructed from a flexible material and attached to the corresponding support member 18 at an angle. Thus, pressing the free end of the tab 42 toward the support member 18 will flex the tab 42, thereby creating a bias in the tab 42 to return to the pre-pressed position.

Figure 2:
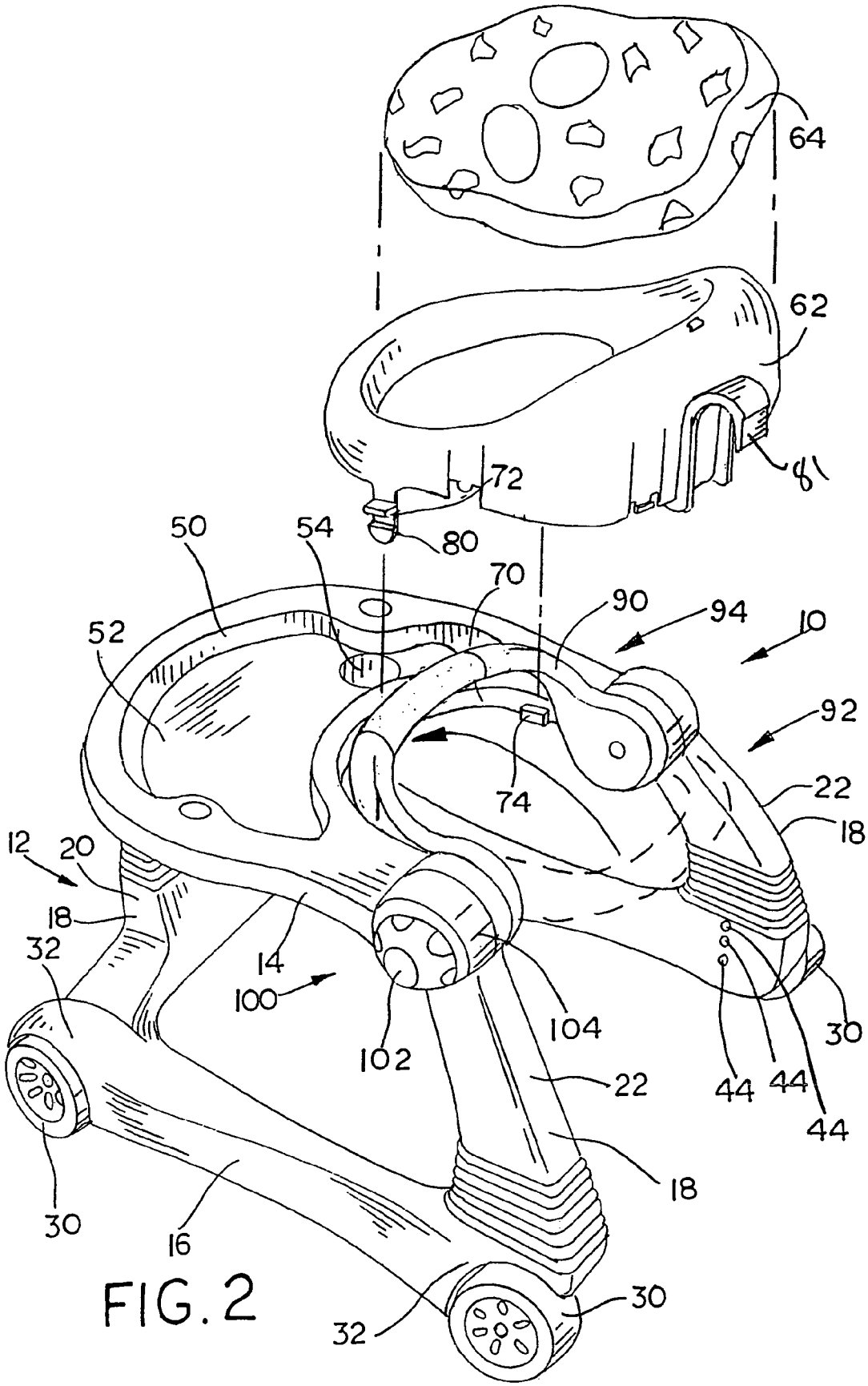
FIG. 2 is an exploded view of the walker of FIG. 1.
Figure 3:
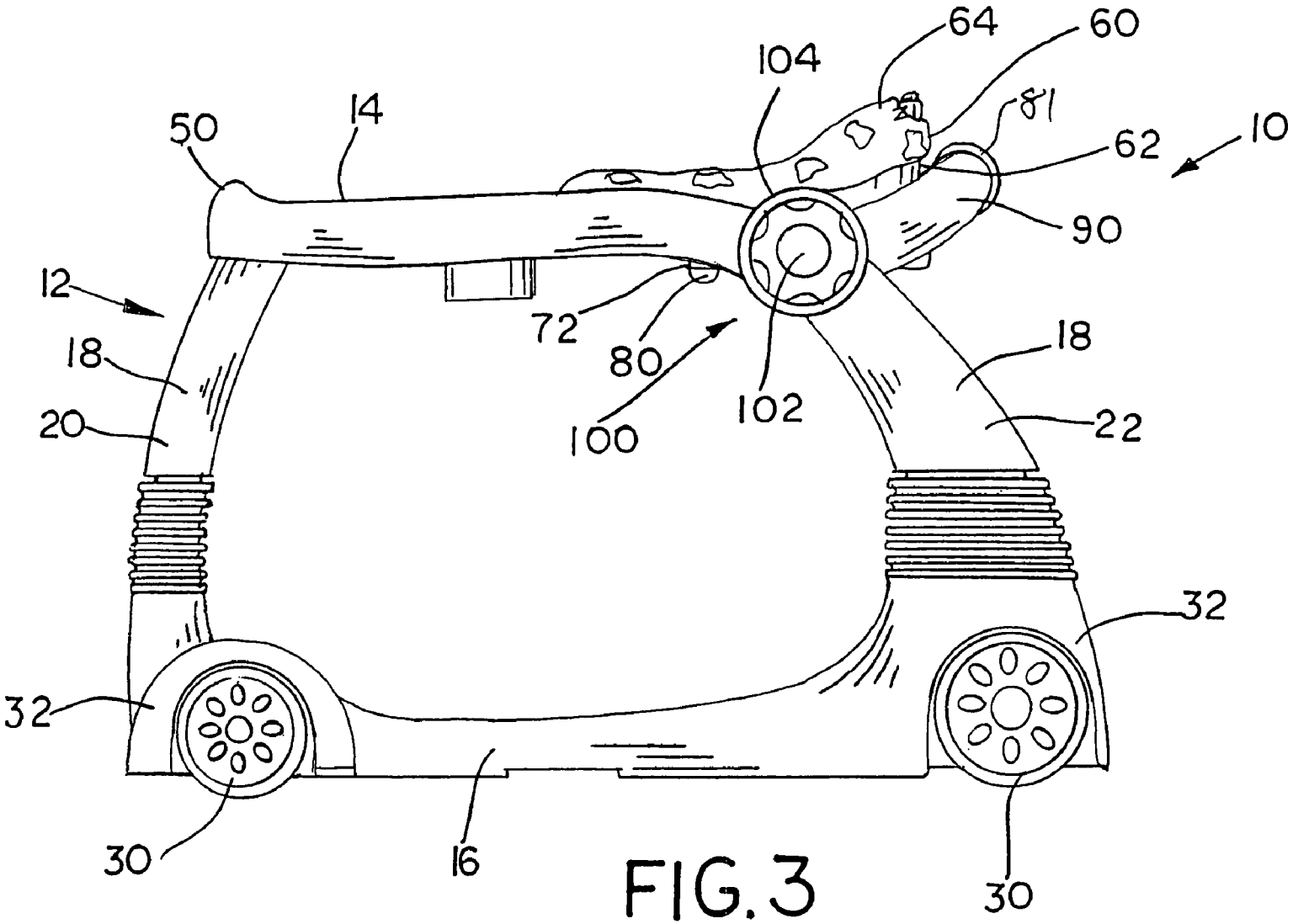
FIG. 3 is a side view of the convertible walker of FIG. 1.
Figure 4:
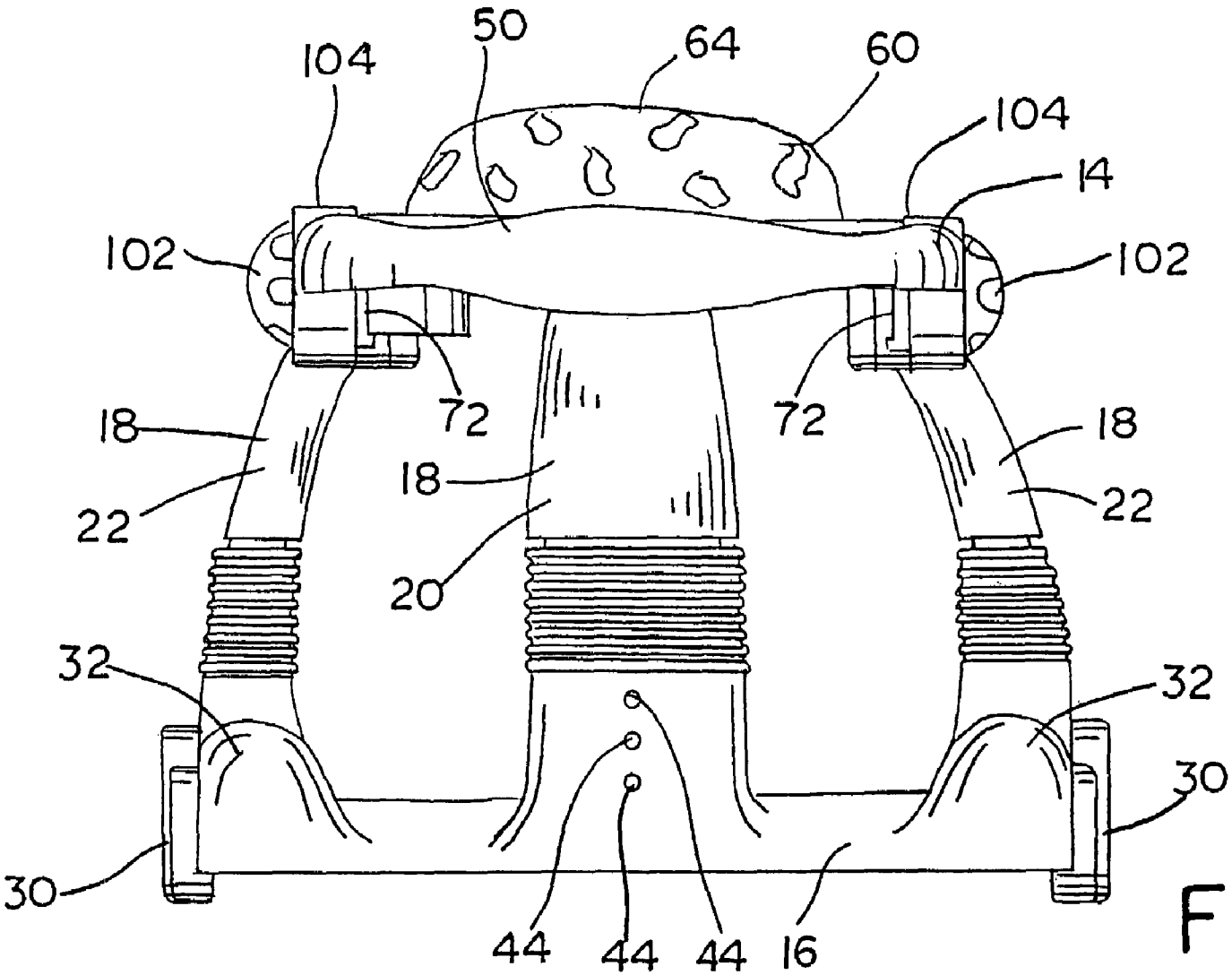
FIG. 4 is a rear elevational view of the convertible walker of FIG. 1.
Figure 5:
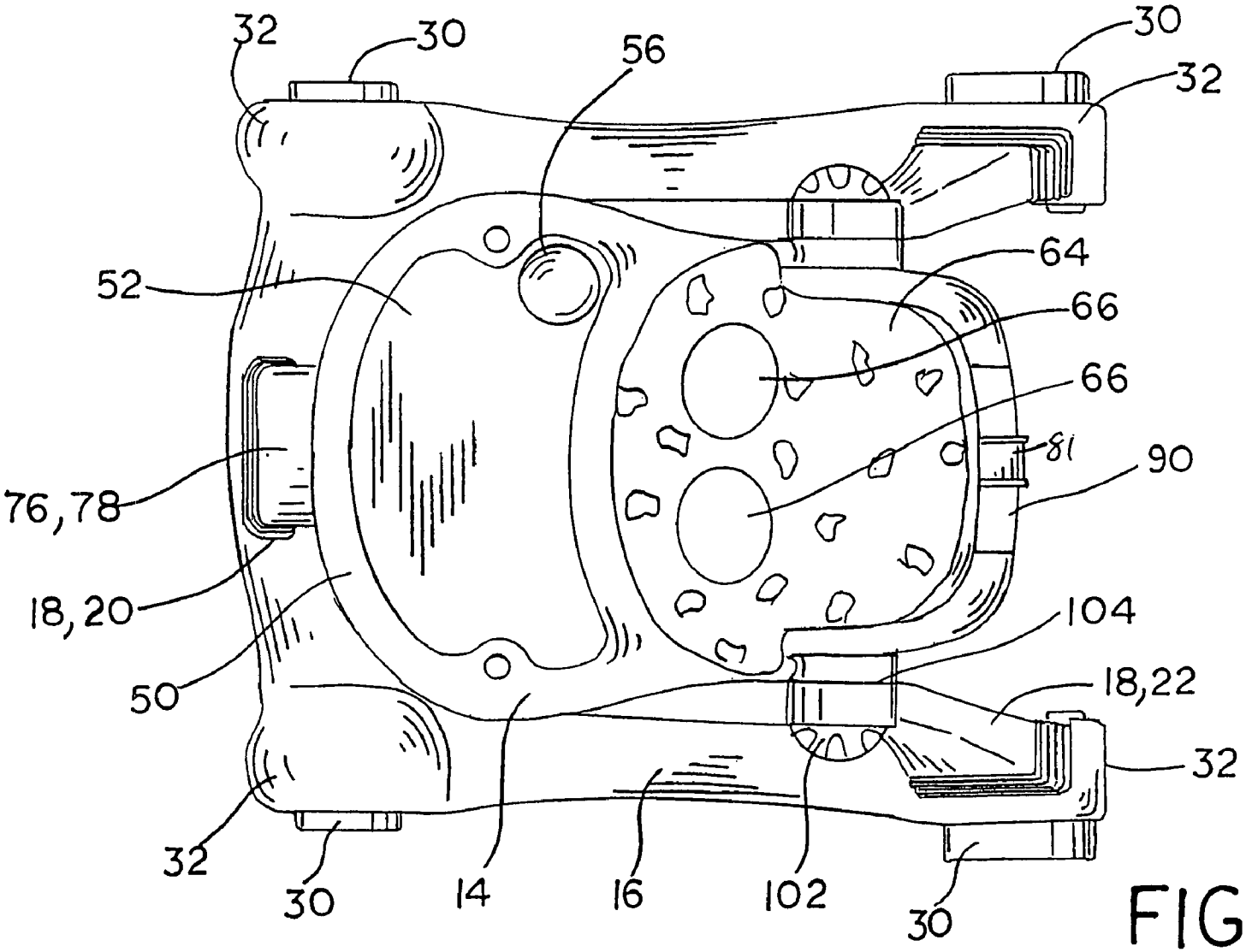
FIG. 5 is a top view of the convertible walker of FIG. 1.

The lower section 16 includes a number of apertures 44 sized for receiving the buttons 40 (see FIG. 2). The apertures 44 are disposed on the lower section 16 where each support member 18 connects to the lower section 16. The apertures 44 are vertically spaced apart by predetermined distance(s) (which may or may not be the same), which corresponds to the height increments by which the upper section 14 may be adjusted relative to the lower section 16. The number of apertures 44 determine the number of height increments by which the support members 18 can be adjusted relative to the lower section 16. One of ordinary skill in the art will readily appreciate that the number of apertures and the distance between each aperture may be selected to provide any desired number of specific height adjustments for the convertible walker 10.

When a support member 18 is connected to the lower section 16 and a corresponding button 40 becomes aligned with an aperture 44, the button 40 snaps into the aperture 44 in a locking manner. The snapping of the button 40 into an aperture 44 is due to the bias in the tab 42, which also prevents the button 40 from coming out of the aperture 44. A user may adjust the height of the convertible walker 10 by pressing the button 40 toward the support member 18 so as to remove the button 40 from the aperture 44. While pressing and holding the button 40, the user can adjust the height of the support member 18 with respect to the lower section 16 by aligning the button 40 with another aperture 44. Releasing the button 40 when nearly aligned with another aperture 44 will cause the button 40 to snap into the aperture 44 to securely connect the support member 18 to the lower section 16. Each support member 18 can be accordingly adjusted for height. Preferably, each support member 18 is set to the same height.

Alternatively, height adjustability can be provided by a conventional X-frame height adjustment mechanism such as those commonly used on conventional child walkers.

To provide a utility and play area for a child, the upper section 18 includes a tray 50 that is accessible to a child when using the convertible walker 10. The tray 50 is attached to the support members 18, and it is generally U-shaped to provide access thereto for a child who is either sitting in the convertible walker 10, or standing and being supported by the convertible walker 10. A forward portion of the tray 50 may include a first recess 52 for maintaining objects within the tray 50, or preventing objects from falling out of the tray 50. The tray 50 may also be used as a food serving tray. When used for serving food, the tray 50 may prevent food items and liquids from falling or spilling on the floor, respectively. Additionally, the tray 50 may include a cup holder in the form of a second recess 54 within the first recess 52 to prevent cups from easily tipping over when a child is using the convertible walker 10.

Figure 7:
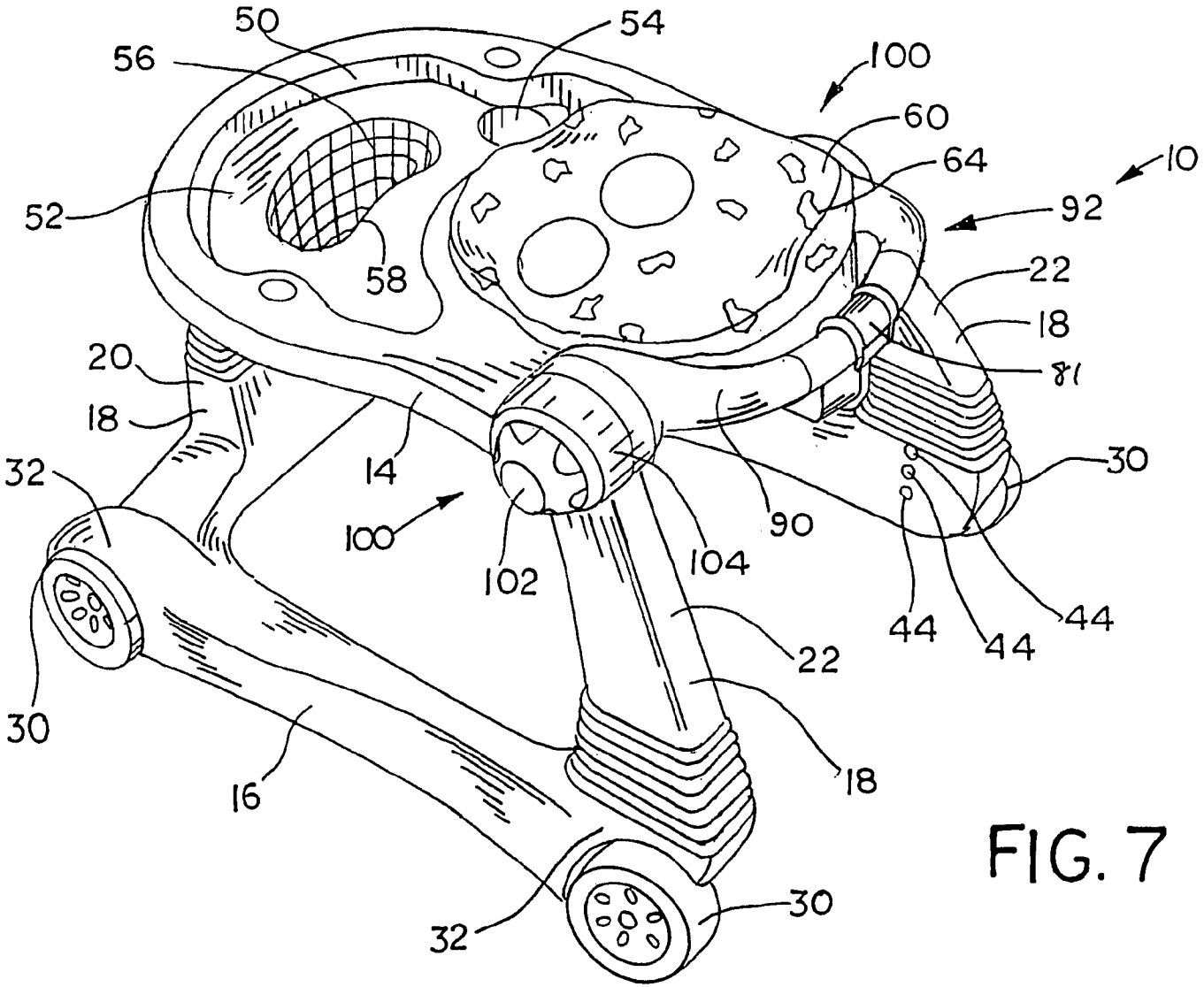
FIG. 7 is a perspective view of another exemplary walker constructed in accordance with the teachings of the instant invention.
Figure 8:
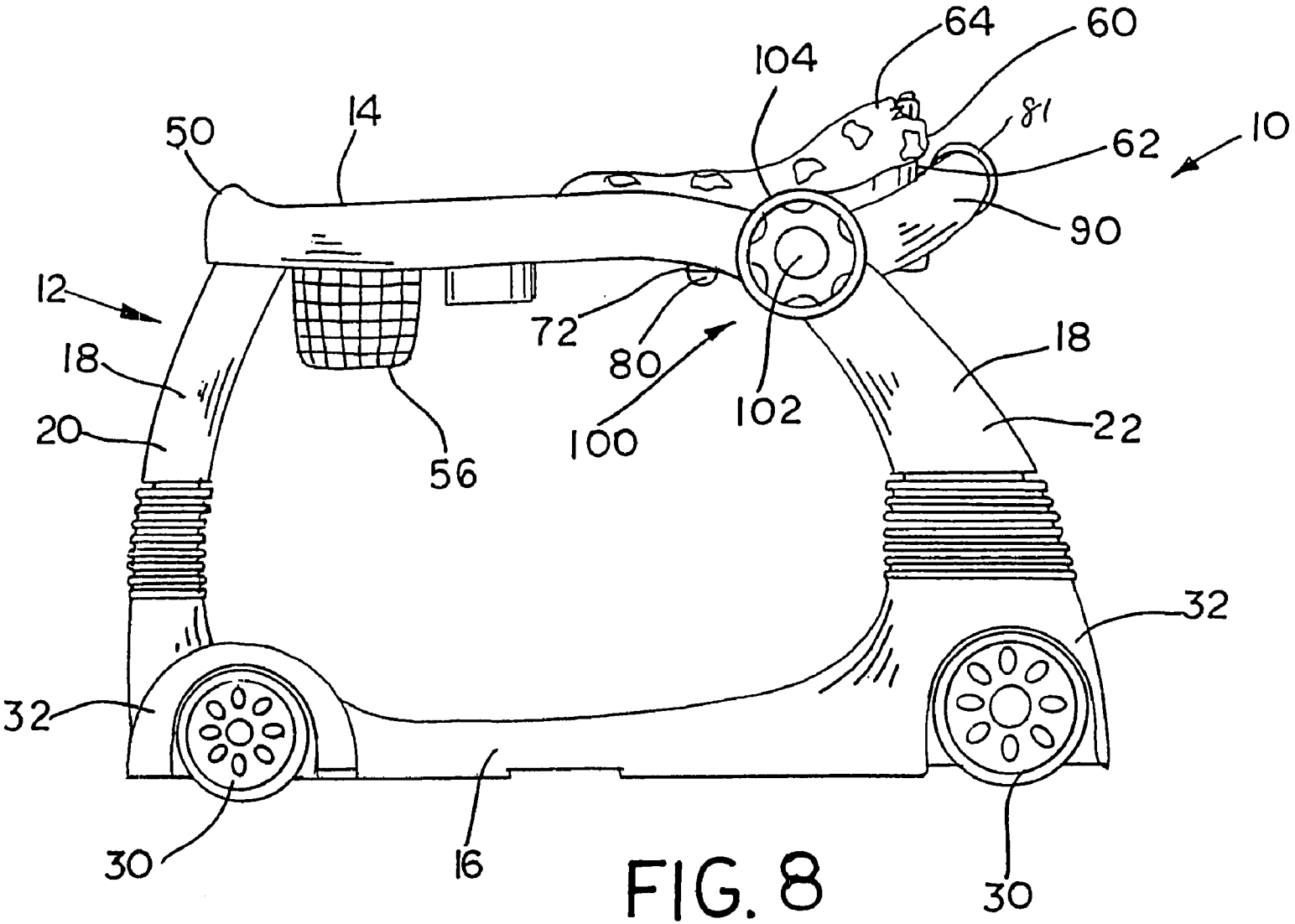
FIG. 8 is a side view of the convertible walker of FIG. 7.

Referring to FIGS. 7 and 8, the tray 50 may optionally include an under mounted basket 56 that is accessible by an opening 58 defined in the tray 50. The basket 56 provides a storage space for toys and other play items. Additionally, the opening 58 on the tray 50 allows a child to view his or her feet, or the ground through the basket 56 when using the walker in either of its modes.

To support a child when in a seated position, the convertible walker 10 includes a seat 60 that is removably attached to the upper section 14. As will be apparent to those of ordinary skill in the art, the seat 60 may be constructed in any shape or with any material so long as it provides adequate and safe support for a child when seated therein. However, in the preferred example, the seat 60 includes a seat ring 62 that is removably attached to the upper section 14, and a support sling or seat cover 64 that is attached to the seat ring 62. The support sling 64 is preferably constructed from any one of the well known natural or synthetic materials typically used for clothing, shoes, or the like, such as canvas, leather, vinyl, cotton, polyester, etc. The seat ring 62 and the seat sling 64 cooperatively support the weight of a child seated in the seat 60, while the flexibility of the seat sling 64 allows the child substantial freedom of movement of the legs to propel the convertible walker 10 in a desired direction. The seat sling 64 includes two leg openings 66, through which the legs of the child are inserted when being placed in the seat sling 64. The seat sling 64 provides support for the weight of a child, while allowing the child's feet to touch the ground so that the child is seated in a suspended upright seating position.

Figure 10:
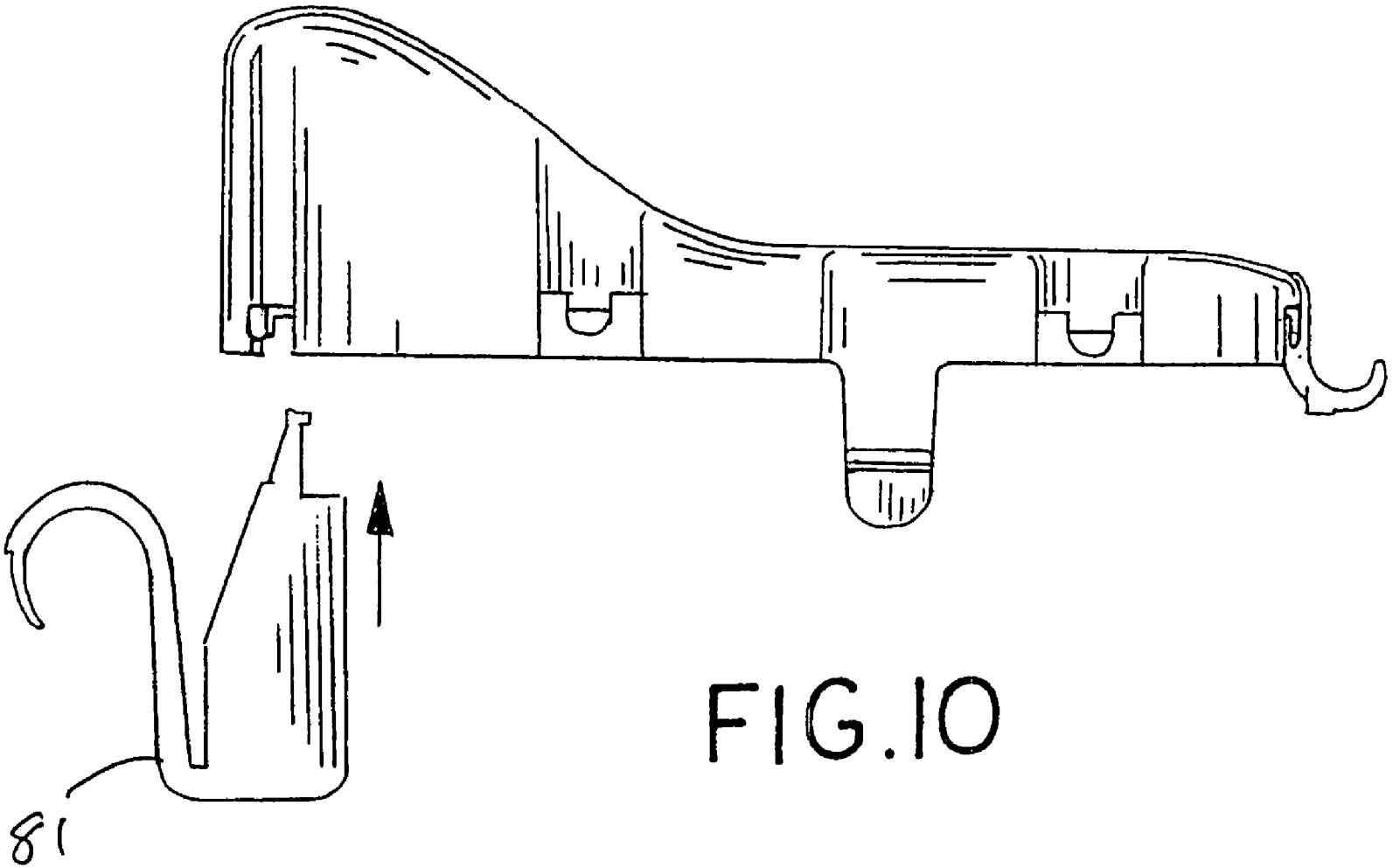
FIG. 10 is a side, exploded view of an example seat ring and hook.
Figure 11:
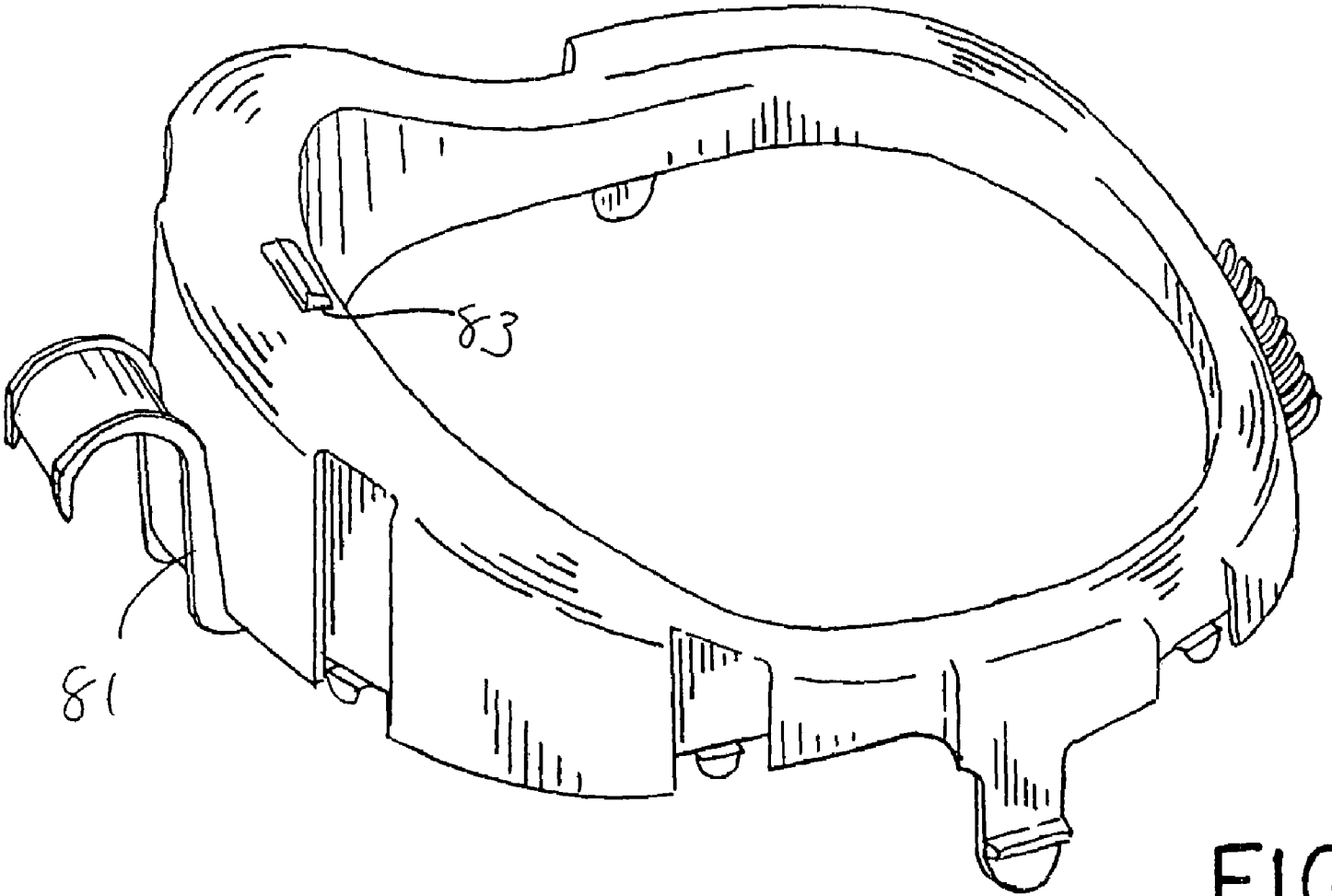
FIG. 11 is a perspective view of the seat ring/hook assembly of FIG. 10.

To securely support the seat 60 when a child is seated therein, the upper section 14 includes a ledge 70 corresponding in size to the forward periphery of the seat ring 62. When the seat 60 is placed in the convertible walker 10, the seat ring 62 rests on the ledge 70 and the weight of the child sitting in the seat 60 is supported by the ledge 70. However, to secure the seat ring 62 from movement when resting on the ledge 70, the seat ring 62 includes two locking tabs 72 that engage two locking members 74 disposed on the upper section 14 and a number of parallel ribs 76 that engage a corresponding number of slots 78 disposed on the upper section 14. The locking tabs 72 are disposed on opposite lateral sides of the seat ring 62, and the corresponding locking members 74 are disposed on the opposite lateral sides of the upper section 14. Each locking tab 72 includes a wedge 80 that engages a corresponding locking member 74 and prevents the seat 60 from upward movement. The ribs 76 are disposed on the forward portion of the seat ring 62, and the corresponding slots 78 are disposed on the forward portion of the ledge 70. The engagement of the ribs 76 with slots 78 prevents the forward portion of the seat ring 62 from movement. Furthermore, engagement of the ribs 76 with the slots 78 assures correct placement of the seat ring 62 on the ledge 70 so that the locking tabs 72 align with corresponding locking members 74. Thus, engagement of the periphery of the seat ring 62 with the ledge 70, the locking tabs 72 with locking members 74, and the ribs 76 with slots 78 securely attach the seat 60 to the upper section 14 of the convertible walker 10. Additionally, as shown in FIGS. 1, 2, 5 and 7, a support hook 81 is mounted to the rear of the seat ring 62 and rests on top of the adjustable handle 90 when in its rear position to further support to the seat As shown in FIGS. 10-11, the hook 81 slides up into the seat ring 62 where it is secured in an aperture 83.

To support a child when standing, the convertible walker 10 includes a handle/convertible member 90 for a child to grip for support. The convertible member 90 may be any shape or size. However, in the preferred example, the convertible member 90 is generally U-shaped to provide a plurality of alternate hand grip positions for a child. Additionally, in the preferred example, the thickness of the convertible member 90 is such that a child can securely grip the convertible member 90. The illustrated convertible member 90 is rotatably attached to the upper section 14 at the open end of that section (e.g., between the ends of the "U" defined by that upper frame 14) and rotates between a rear locking position 92 (shown in FIGS. 1 and 3-6) and a front locking position 94 (shown in FIG. 2). Preferably, the convertible member 10 is rotated between the rear locking position 92 and the front locking position 94 without being detached from the frame 12. In the rear locking position 92, the convertible member 90 is located behind the seat 60 in a stowed away position. Alternatively, in the rear locking position 92, the convertible member 90 can be positioned beneath the seat 60 to provide additional support for the seat 60. In the rear locking position 92 of the convertible member 90, the convertible walker 10 functions as a traditional walker such that a child may be seated in the seat 60 in the pseudo standing position. Additionally, in the rear locking position 92, the convertible member 90 can be gripped by a child who is walking behind the convertible walker 10. In the front locking position 94 shown in FIG. 2, the seat 60 is removed from the convertible walker 10, and the convertible member 90 can be gripped by a child to either stand in place or walk in a desired direction. In the illustrated example child gripping the convertible member 90 when in the front locking position 94 will be positioned in the U-shaped portion of the frame 12. When the child is positioned within the U-shaped portion of the frame they are surrounded for added stability.

Figure 6:
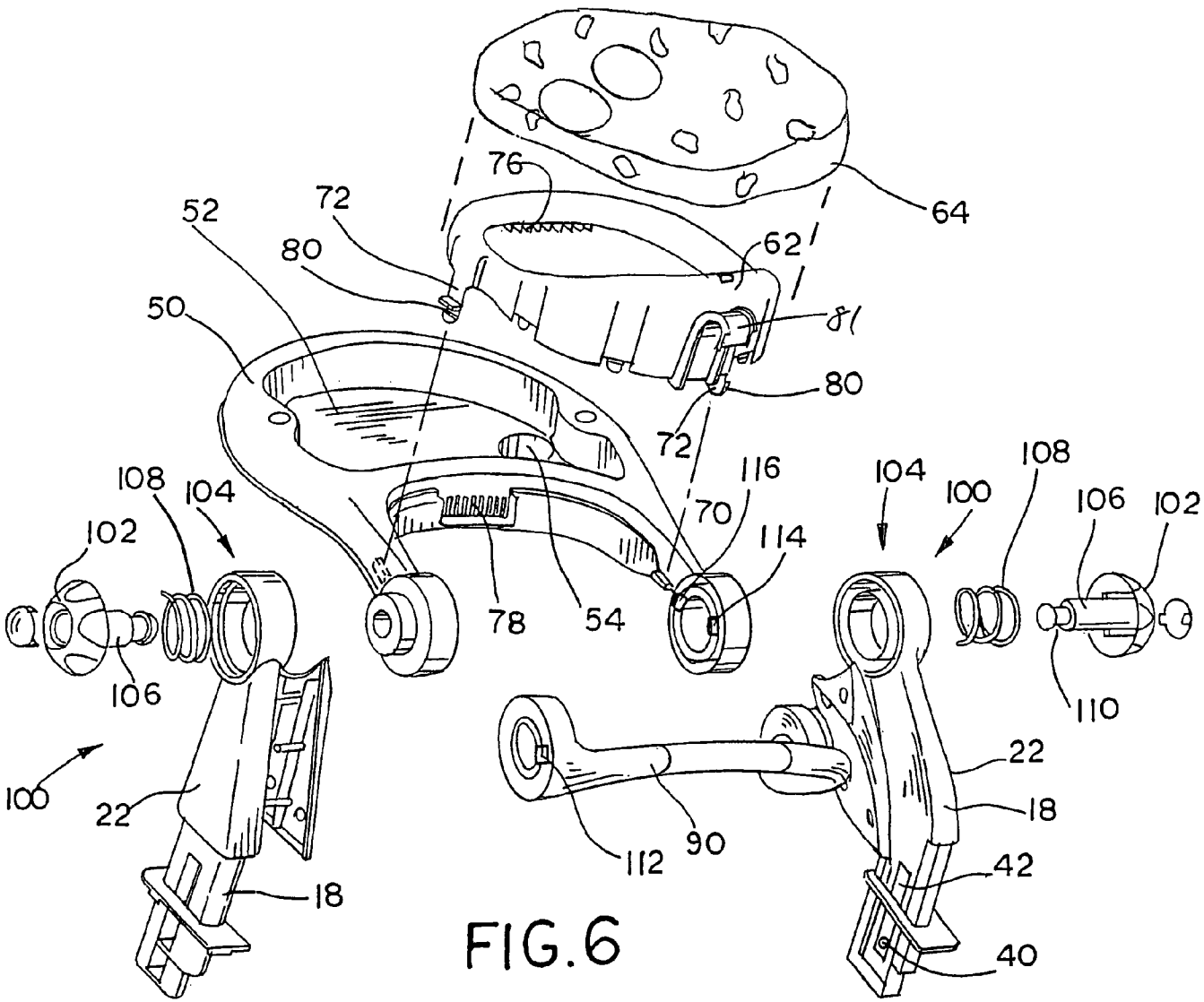
FIG. 6 is an exploded view of portions of the convertible walker of FIG. 1.

To rotate the convertible member 90 from the rear locking position 92 to the front locking position 94, the convertible walker 10 includes a lock and release mechanism 100. Referring to FIG. 6, the illustrated lock and release mechanism 100 includes two locking knobs 102 rotatably connected at hubs 104 of the rear support members 22, the upper section 14, and the convertible member 90. Each locking knob 102 includes a shaft 106 rotatably positioned in the hubs 104, and, optionally, a spring 108 that biases the locking knobs 102 outward. However, in the preferred implementation, the springs 108 are omitted and the bias force is provided by the resilience of the molded plastic convertible member 90. Each shaft 106 includes a tooth 110 disposed at its end. Each side of the convertible member 90 that is rotatably connected to a corresponding hub 104 includes a slot 112 sized for receiving the tooth 110 of a corresponding locking knob 102. Also, each hub 104 includes a rear slot 114 and a front slot 116, both sized for receiving the tooth 110 of a corresponding locking knob 102.

When the convertible member 90 is in a rear locking position 92, the rear slot 114 of each hub 104 is aligned with the slot 112 of the convertible member 90, and the tooth 110 of a corresponding locking knob 102 is disposed in both the rear slot 114 of the hub 104 and the slot 112 of the convertible member 90. Thus, the hub 104 and the convertible member 90 are locked together in the rear locking position 92. Additionally, the springs 108, or, preferably, the resiliency of the convertible member 90, bias the locking knobs 102 outward to prevent each tooth 110 from being removed from the corresponding rear slot 114 and slot 112 of the convertible member 90. When the convertible member 90 is in the front locking position 94, the front slot 116 of each hub 104 is aligned with the slot 112 of the convertible member 90, and the tooth 110 of a corresponding locking knob 102 is disposed in both the front slot 116 and the slot 112 of the convertible member 90. Thus, the hub 104 and the convertible member 90 are locked together in the front locking position 94. Additionally, the springs 108, or in preferably, the resiliency of the convertible member 90, bias the locking knobs 102 outward to prevent each tooth 110 from being removed from the corresponding front slot 116 of the hub 104 and slot 112 of the convertible member 90.

One of ordinary skill in the art will readily appreciate that the lock and release mechanism 100 is not limited to having only two locking positions. On the contrary, the hub 104 may include a plurality of slots similar to the rear slot 114 and the front slot 116 that can provide a plurality of different locking positions for the convertible member 90. One of ordinary skill in the art will also appreciate that the lock and release mechanism 100 is not limited to that described in the foregoing. On the contrary, any known lock and release mechanisms that provides for the convertible member 90 to be releasably secured in both a rear locking position 92 and a front locking position 94 may be used. For instance, the locking knobs 102 may include shafts 106 that are threaded to engage a corresponding counter threading in the hubs 104. The convertible member 90 may then be locked to and released from the hub 104 by tightening and loosening the locking knobs 102, respectively.

To convert the illustrated convertible walker 10 from a seating configuration to a standing configuration, the seat 60 is removed from the upper section 14 and the handle 90 is rotated from the rear locking position 92 to the front locked position 94. The seat 60 may be removed by pressing the locking tabs 72 inward until the locking wedges 80 disengage from the corresponding locking members 74. The rear portion of the seat 60 can then be lifted and pulled out of the upper section 14, which also causes the ribs 76 to be pulled out of the slots 78 for a complete removal of the seat 60 from the upper section 14. To rotate the convertible member 90 from the rear locking position 92 to the front locking position 94, the locking knobs 102 are pressed inward against the bias force to push the teeth 110 out from the corresponding rear slots 114 of the hubs 104. The teeth 110, however, remain in the corresponding slots 112 of the convertible member 90. While holding the locking knobs 102 in the pushed-in position, the locking knobs 102 are rotated forward, thereby rotating the convertible member 90 toward the front locking position 94. When the convertible member 90 reaches the end of its rotational path (i.e., the convertible member 90 will not rotate forward anymore), which corresponds to the front locking position 94, the locking knobs 102 are released, thereby causing the bias force to push the locking knobs 102 outward to insert each tooth 110 in a corresponding front slot 116 of the hubs 104. At this point, the convertible member 90 is locked in the front locking position 94.

To convert the convertible walker 10 from a standing configuration to a seating configuration, the handle 90 is rotated from the front locking position 94 to the rear locking position 92, and the seat 60 is then attached to the upper section 14. To rotate the handle/convertible member 90 from the front locking position 94 to the rear locking position 92, the locking knobs 102 are pressed inward against the bias force to release the convertible member 90 from the hub 104, as described in the foregoing. The locking knobs 102 are then rotated from the front locking position 94 to the rear locking position 92, thereby rotating the convertible member 90 accordingly. When the convertible member 90 reaches the end of its rearward rotational path (i.e., the convertible member 90 cannot be rotated anymore), which corresponds to the rear locking position 92, the locking knobs 102 are released, and the bias force causes insertion of the teeth 110 into the rear slots 114 of the hubs 104. Once the convertible member 90 is locked in the rear locking position 92, the convertible walker 10 can receive the seat 60. The seat 60 is attached to the upper section 14 by first inserting the ribs 76 in the slots 78 to correctly position the seat 60 on the ledge 70 for alignment of the locking tabs 72 with the locking members 74. The seat 60 is then moved downward toward the ledge 70. The downward movement of the seat 60 causes each locking wedge 80 to slide on a corresponding locking member 74, thereby bending the corresponding locking tab 72. When each locking wedge 80 slidably moves below the corresponding locking member 74, the flexing of the locking tab 72 causes the locking wedge 80 to snap into a position below the locking member 74, thereby locking the seat 60 to the upper section 14.

Figure 9:
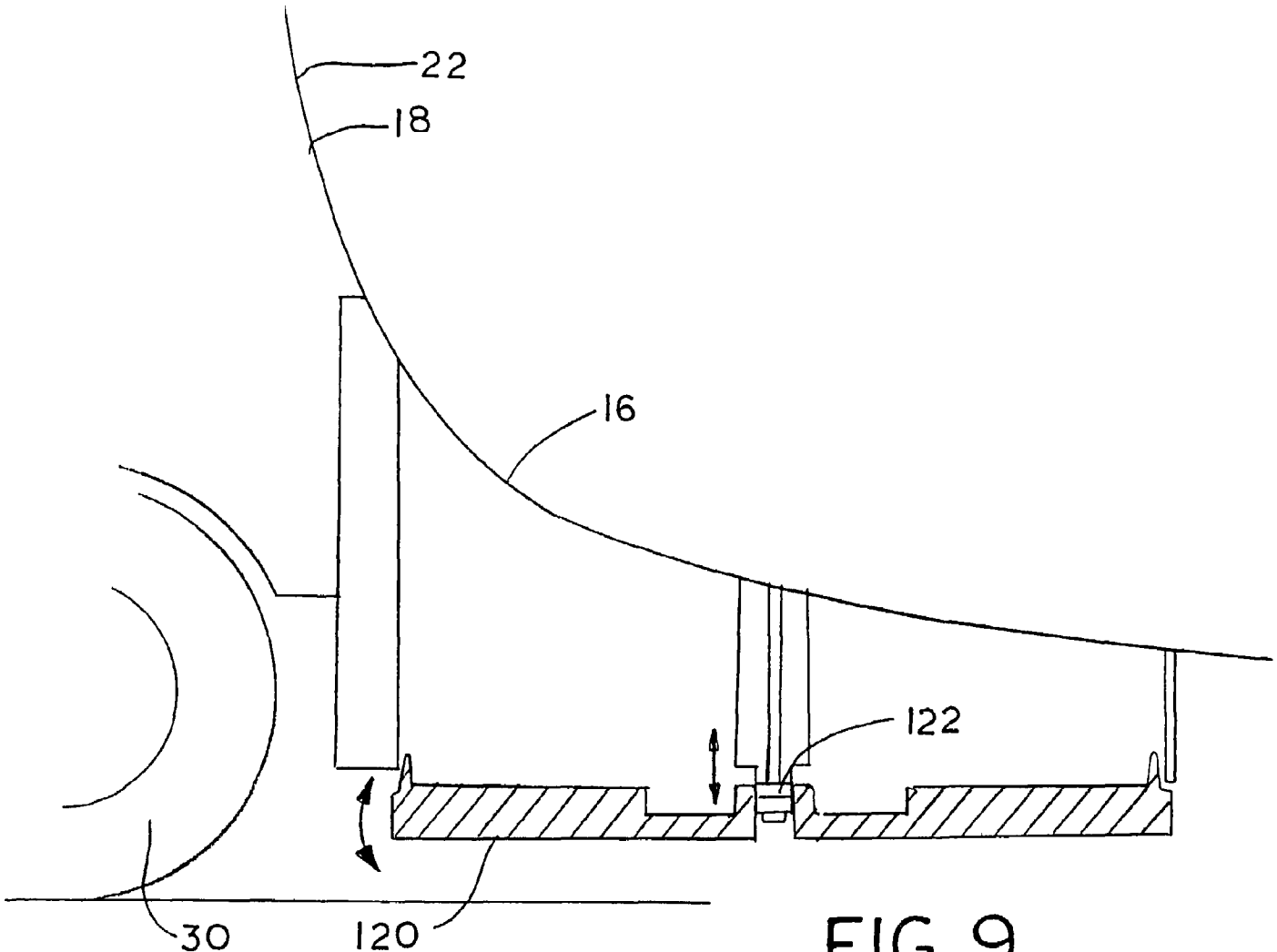
FIG. 9 is fragmentary side view of an exemplary braking mechanism constructed in accordance with the teachings of the instant invention.

Referring to FIG. 9, to provide a braking mechanism for the convertible walker 10 when one or more wheels 30 go beyond the edge of a surface, the lower section 16 includes floating brake pads 120 on its underside. Each brake pad 120 is pivotally attached to a boss 122 that is disposed on the underside of the lower section 16. Each brake pad 120 is provided with the freedom to move vertically within a predetermined vertical range and to swivel about a corresponding boss 122 again about a predetermined angular range. When a wheel 30 goes beyond the edge of a surface, the brake pad(s) 122 nearest the edge move vertically and/or swivel to frictionally engage the edge of the surface and stop the convertible walker 10 from further movement. The floating feature provides each brake pad 120 with the ability to adapt to the shape and angle of an edge of a surface when one or more wheels 30 are not horizontally level with the other wheels 30 due to a drop or sudden change in the elevation of a surface.

Although the preferred example includes a U-shaped wheeled base 16 and a U-shaped upper frame 14, persons of ordinary skill in the art will appreciate that other shapes and configurations (including, for example, closed configurations) are also possible. By way of example, the wheeled base 16, the upper frame 14, and/or both can optionally include a removable section such that the wheeled base 16, the upper frame 14 and/or both the base 16 and the upper frame 14 define an enclosure when the removable section(s) is/are attached, and become open-sided (e.g., U-shaped) when the removable section(s) is/are removed. This alternative conversion process is available because the U-shaped structure is not needed when the child is using the seat, but is preferred when the child is using the walker without the seat for enhanced stability by allowing the child to stand within the base footprint.

Persons of ordinary skill in the art will further appreciate that, although in the preferred example, the seat 60 is removable, the seat could alternatively be permanently secured to the walker. For example, the seat could be foldable or collapsible to a stowed position when not in use (e.g., when the handle 90 is moved to the forward position).

Additionally, persons of ordinary skill in the art will appreciate that, although in the preferred example the handle 90 is secured to the walker for pivoting movement, the handle may adjust or convert in other fashions (e.g., sliding movement). Further, the handle could alternatively be removable from the walker. For example, the handle may also be attachable to the walker in two or more positions. For instance, rather than pivoting the handle 90 between the forward and rearward positions as illustrated above, the handle 90 could optionally be removed from the walker and reattached in either of the first and second positions.

Alternatively, the walker may include two handles, one that is positioned behind, and used to support the seat 60, and one that is located forward of the seat. Then to convert the walker, the seat and rearmost handle are removed, or the rearmost handle is removed and the seat 60 is folded or collapsed to a stowed position.

Alternatively, the tray 50 or another portion of the upper frame 14 (e.g., the center leg of the "U" formed by the upper frame 14) can include an integral handle. In such an approach, the handle 90 can optionally be eliminated. Alternatively, the handle 90 can be replaced with a removable member such that the U-shaped upper frame 14 forms an enclosure with the removable member when the removable member is attached, but permits access to the integral handle when the removable section is removed.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A child walker comprising:

a U-shaped base;

wheels mounted to the base such that the base is positioned immediately adjacent a ground surface;

an upper frame mounted on the wheeled base and having a U-shape; and a removable seat removably mounted to the upper frame to support a child in a suspended upright seated position to operate the walker in a first walker mode, wherein the child stands within the U-shape when the seat is completely removed from the upper frame to operate the walker in a second walker mode.

2. A child walker comprising:

a wheeled base having a first U-shape in a first plane immediately adjacent a ground surface;

an upper frame having a second U-shape in a second plane generally parallel to the first plane;

a support to mount the upper frame above the wheeled base; and a seat which is not directly mounted to the wheeled base and is positioned at a seating height above the first plane and below the second plane.

3. A child walker as defined in claim 2 wherein the seat is removable.

* * * * *